US010240809B1

(12) United States Patent
Duvivier

(10) Patent No.: US 10,240,809 B1
(45) Date of Patent: Mar. 26, 2019

(54) WIRELESS CONDENSER CONTROLLER

(71) Applicant: Michael Duvivier, San Fernando, CA (US)

(72) Inventor: Michael Duvivier, San Fernando, CA (US)

( * ) Notice: Subject to any disclaimer, the term of this patent is extended or adjusted under 35 U.S.C. 154(b) by 929 days.

(21) Appl. No.: 14/637,367

(22) Filed: Mar. 3, 2015

Related U.S. Application Data

(60) Provisional application No. 61/947,757, filed on Mar. 4, 2014.

(51) Int. Cl.

| | |
|---|---|
| ***F24F 11/30*** | (2018.01) |
| ***F24D 19/10*** | (2006.01) |
| ***F24F 11/62*** | (2018.01) |
| *F24F 11/56* | (2018.01) |

(52) U.S. Cl.
CPC ..... *F24F 11/30* (2018.01); *F24D 19/1084* (2013.01); *F24F 11/62* (2018.01); *F24F 11/56* (2018.01)

(58) Field of Classification Search
CPC ..... G05D 23/1905; F24F 11/30; F24F 11/62; F24F 11/56; F24D 19/1084
USPC ..... 236/51
See application file for complete search history.

(56) References Cited

U.S. PATENT DOCUMENTS 3,922,876 A * 12/1975 Wetherington, Jr. ... F25B 40/04 62/177
3,989,097 A * 11/1976 Schildknecht ..... F24F 3/14 165/228
4,094,166 A * 6/1978 Jerles ..... F24F 11/0009 236/46 R
4,132,355 A * 1/1979 Cleary ..... F24F 11/0009 236/47
4,776,179 A 10/1988 Ta
4,948,044 A * 8/1990 Cacciatore ..... H02J 9/061 165/238
5,224,648 A * 7/1993 Simon ..... F24F 11/00 165/259
5,711,480 A 1/1998 Zepke et al.
5,833,134 A 11/1998 Ho
5,914,656 A * 6/1999 Ojala ..... G01D 4/004 340/521
5,927,599 A 7/1999 Kath
6,152,375 A 11/2000 Robison
6,619,055 B1 9/2003 Addy
8,376,242 B1 2/2013 Uselton
8,393,550 B2 * 3/2013 Simon ..... F24F 11/0012 236/51

(Continued)

*Primary Examiner* — Henry T Crenshaw
(74) *Attorney, Agent, or Firm* — Thomas I. Rozsa

(57) ABSTRACT

A wireless connection between an air conditioning unit or heat pump condenser and a split system furnace or air handler where the furnace or air handler is in the structure and the air conditioning condensing unit or heat pump condenser are external to the structure, and a thermostat in the structure which controls the air conditioning or heat pump unit. In this way, when a cooling signal from a thermostat goes out, the circuit board is energized and turns on the air conditioning or heat pump portion of the air conditioning unit which is wired internally to the compressor so that cooling or heating in the structure occurs. The wireless circuit board eliminates the need for having the hard wired communication between the furnace or air handler and the air conditioning condenser or the heat pump condenser.

6 Claims, 3 Drawing Sheets

(56) References Cited

U.S. PATENT DOCUMENTS

2004/0071471 A1* 4/2004 Baker ..... H04B 10/1143
398/140
2004/0174287 A1* 9/2004 Deak ..... G08C 17/02
341/173
2005/0016191 A1* 1/2005 Butler ..... F24F 11/008
62/158
2005/0033479 A1* 2/2005 Parker ..... F16K 37/0075
700/282
2005/0257544 A1* 11/2005 Lee ..... F24F 11/0079
62/229
2006/0042283 A1 3/2006 Hwang et al.
2006/0097063 A1* 5/2006 Zeevi ..... F24F 11/0086
236/49.3
2006/0097890 A1* 5/2006 Atkins ..... G08C 17/02
340/13.25
2007/0114293 A1* 5/2007 Gugenheim ..... F24F 11/0012
236/49.3
2007/0131784 A1* 6/2007 Garozzo ..... F24F 11/30
236/51
2008/0147242 A1* 6/2008 Roher ..... F24F 11/0012
700/278
2008/0284573 A1* 11/2008 Stambaugh ..... H04L 12/66
340/286.02
2009/0088902 A1* 4/2009 Williams ..... F24F 11/0009
700/278
2010/0043469 A1* 2/2010 Lifson ..... F25B 49/025
62/228.1
2010/0182743 A1* 7/2010 Roher ..... G05D 23/1917
361/679.41
2010/0280677 A1* 11/2010 Budike, Jr. ..... H05B 37/0272
700/296

* cited by examiner

WIRELESS CONDENSER CONTROLLER

CROSS-REFERENCE TO RELATED APPLICATION

This patent application claims priority to Provisional Application No. 61/947,757 filed on Mar. 4, 2014.

BACKGROUND OF THE INVENTION

1. Field of the Invention

The present invention relates to the field of air conditioning units in structures including residential and commercial structures and how the air conditioning units which serves to cool the interior of these structures are controlled by thermostats.

2. Description of the Prior Art

The following ten patents and published patent applications are the closest prior art references to the present invention.

1. U.S. Pat. No. 4,776,179 issued to S. Henry Ta on Oct. 11, 1988 for "Radio-Linked Automatic Climate Control System For Motor Vehicle Air Conditioning" (hereafter the "Ta Patent");
2. U.S. Pat. No. 5,224,648 issued to Bernard S. Simon et al. on Jul. 6, 1993 for "Two-Way Wireless HVAC System And Thermostat" (hereafter the "Simon Patent");
3. U.S. Pat. No. 5,711,480 issued to Bruce E. Zepke et al. on Jan. 27, 1998 for "Low-Cost Wireless HVAC Systems" (hereafter the "Zepke Patent");
4. U.S. Pat. No. 5,833,134 issued to Tienhou Joseph Ho on Nov. 10, 1998 for "Wireless Remote Temperature Sensing Thermostat With Adjustable Register" (hereafter the "Ho Patent");
5. U.S. Pat. No. 5,927,599 issued to Miles E. Kath on Jul. 27, 1999 for "Wireless Air Conditioning Control System" (hereafter the "Kath Patent");
6. U.S. Pat. No. 6,152,375 issued to Jerry L. Robison on Nov. 28, 2000 for "Remote Control Thermostat System For Controlling Electric Devices" (hereafter the "Robison Patent");
7. U.S. Pat. No. 6,619,055 issued to Kenneth L. Addy on Sep. 16, 2003 for "Security System With Wireless Thermostat And Method of Operation Thereof" (hereafter the "Addy Patent");
8. United States Published Patent Application No. 2006/0042283 to Yoon-Jei Hwang et al. on Mar. 2, 2006 for "Air-Conditioner And Controlling Method Therefor" (hereafter the "Hwang Published Patent Application");
9. U.S. Pat. No. 8,376,242 issued to Robert B. Uselton on Feb. 19, 2013 for "Wireless User Interface For An HVAC Controller And Method of Operating the Same" (hereafter the "Uselton Patent");
10. U.S. Pat. No. 8,393,550 issued to Timothy M. Simon et al. on Mar. 12, 2013 for "Thermostat Assembly with Removable Communication Module and Method" (hereafter the "Simon Patent").

The Ta Patent is related to vehicle air conditioning. It discloses an electronic thermostat, a radio transmitter to transmit the on/off signals of the thermostat and the radio receiver to capture the audio signals which will drive a switching circuit to turn on or off the vehicle air conditioner.

The Simon Patent discloses a two-way wireless HVAC system and thermostat. It discloses a two-way wireless system but its entire intent is to sense when air conditioning is needed and then provide an appropriate signal to have the air conditioning unit to transmit air conditioning to specific units within a building.

The Zepke Patent discloses a wireless transmitter that senses when there is a temperature requirement for air conditioning to turn on the air conditioning unit. The device is a wireless HVAC system which employs low cost, low power, surface acoustic wave SAW stabilizer, narrow band AM radio transmitters and receivers as communication links between the operative elements.

The Ho Patent discloses a wireless remote temperature sensing thermostat with adjustable register. In general, the patent discloses:

> "A wireless remote temperature sensing and control thermostat system for regulating air ducted air conditioning systems incorporating a normal mode and a remote control mode, including a combination thermostat and radio-frequency receiver unit, a radio-frequency transmitter, and an adjustable register. In the normal mode, a reference temperature is set by the thermostat for the temperature throughout the entire air conditioned structure. In the remote control mode, the local temperature sensing and control functions of the thermostat are disabled and the transmitter unit will take over the temperature sensing at the remote site which, in turn, then will control the thermostat unit. As a result, the users will be able to more accurately control their own personal environment."

The Kath Patent discloses:

> "A wireless air conditioning control system is provided. A thermostat assembly measures ambient temperature in an area to which an air conditioning system provides conditioned air. It compares the measured ambient temperature with a predetermined target temperature and wirelessly transmits air conditioning request signals to an air conditioning control assembly responsively to the comparison. The thermostat assembly and the air conditioning control assembly may be automatically mated with one another so that the air conditioning control assembly responds to air conditioning request signals only from a particular thermostat assembly. Where a plurality of transmitters are present, their transmissions are staggered to avoid data collision. The control assembly includes a freeze protection mechanism to protect against freezing conditions in the absence of air conditioning request signals. A battery powered thermostat assembly is intermittently partially shut down to reduce power consumption. The transmitter assembly predicts temperature to account for thermal inertia."

The Robison Patent discloses a remote control thermostat system for controlling electric devices. It controls both the heating and cooling devices. The patent discloses:

> "A remote control thermostat system for controlling electric devices for remotely controlling electric heating and cooling devices for regulating temperatures inside a structure. The remote control thermostat system for controlling electric devices includes a thermostat with a transmitter for emitting signals varying with the ambient temperature around the thermostat. A control unit is in communication with a power source and has a receiver for receiving the signals from the thermostat. The control unit is adapted for selectively permitting flow of power to an electric device in response to signals received from the thermostat."

The Addy Patent discloses:

"An air temperature controller unit (e.g. a furnace and/or an air conditioner) including an air temperature controller RF receiver for receiving RF signals to control its operation, and a wireless thermostat having a unique thermostat identification indicia associated therewith. The thermostat has a thermostat RF transmitter configured to transmit air temperature control signals to the air temperature controller unit via the air temperature controller RF receiver to control its operation in accordance with a preprogrammed air temperature profile."

The Hwang Published Patent Application discloses an air conditioner and controlling method therefore. Specifically, the patent application discloses:

"Disclosed are an air-conditioner which does not require a communication line, which connects an indoor unit to a thermostat, to mount in an indoor wall and a user can easily move the thermostat as occasion demands, and a controlling method therefor. The air-conditioner according to the present invention comprises: the thermostat for converting a control signal to control an indoor fan and a compressor of an outdoor unit in the air-conditioner into a radio frequency (RF) signal, and transmitting the converted RF signal; and the indoor unit for receiving the RF signal, and generating the control signal to control the indoor fan and the compressor of the outdoor unit based on the received RF signal."

The Uselton Patent discloses a wireless user interface for an HVAC controller and method for operating the same. It discloses:

"A wireless user interface for an HVAC controller, a method of operating a wireless user interface for an HVAC controller and an HVAC system incorporating the wireless user interface or the method. In one embodiment, the wireless user interface includes: (1) a chassis having a display and at least one control button and containing a temperature sensor and wireless communication circuitry and (2) a microcontroller configured to cause the wireless communication circuitry to generate outbound data packets for wireless transmission to the HVAC controller containing temperature readings from the temperature sensor and when the at least one control button is pressed and receive inbound data packets from the HVAC controller that determine a content of the display."

The Simon Patent discloses a thermostat assembly with a removable communication module and method. Specifically, the patent discloses:

"A thermostat assembly comprises a thermostat and a removable and replaceable first communication module physically and functionally removably connected to the thermostat. The first communication module is configured to permit information transfer between the thermostat and a first device remote from the thermostat. If more than one communication module is used to communicate with more than one device, the communication modules may operate using different communication protocols."

SUMMARY OF THE INVENTION

The present invention provides a wireless connection between an air conditioning condensing or heat pump condensing unit for a structure and a thermostat in the structure which control the air conditioning unit. In the prior art known to the inventor who services heating and air conditioning units, the connection from the furnace or air handler to the air conditioning condensing or heat pump condensing unit is hardwired and often the wire is chewed by animals such as mice, rats and squirrels. This is especially true where the condenser or heat pump is either outside on the roof or on the ground and is a significant distance away from the furnace or air handler. Although today's technology is going wireless, most people cannot afford it. The purpose of the present invention is to use the existing 24 v thermostat and send a wireless signal to the outside condensing unit or heat pump, thereby also saving the repair of broken or chewed wires.

It is an object of the present invention to provide a wireless circuit board so that there is a wireless connection between the thermostat, furnace or fan coil in a structure and the condenser for the air conditioning or heat pump condenser. In this way, when a cooling signal from the thermostat goes out, the circuit board is energized and turns on the air conditioning or heat pump condenser portion of the air conditioning unit or heat pump condensing unit which is wired internally to the compressor so that cooling or heating in the structure occurs. The present invention wireless circuit board eliminates the need for having the hardwired communication between the furnace or fan coil out to the air conditioning condensing unit or outdoor unit when used as a heat pump application.

While problems in the prior art are traditionally discussed in the Background Of The Invention section, for relevance, the problem to be solved by the present invention is discussed here. The problem to be solved is summarized as follows. The state of the art includes wireless thermostats that are linked to wireless furnaces. To the best of the present inventor's knowledge, there is no wireless apparatus linking the thermostat to the air conditioner condenser unit usually located outside on the ground or on the roof of the residence. This setup still requires thermostat wires from the inside furnace to the air conditioning condenser or heat pump unless a total wireless system is installed. In these instances, the contractor pulls either two- or five-strand thermostat wires through the walls or across the attic with the refrigeration line set. The problem with this is if a strand is broken in the thermostat wire casing, there are only one to three extra strands to work with. If wires break down or are chewed up by rodents or other animals, then a new set of thermostat wires must be pulled. The pulling of this set of thermostat wires usually requires walls to be opened up to fish new wire through to the condensing unit or have an electrician run conduit from the furnace to outside where the air conditioning unit is located. Major repairs will need to be performed after the repair of the wire is completed, such as plastering, stucco repair and painting to match existing paint and also additional time and material for the electrician.

The solution to the above described problem as discovered by the present inventor is to make a wireless transmitter which will receive 24 v from the thermostat and send a wireless signal to the receiver at the condensing unit or heat pump and bring on the air conditioning condenser or a heat pump condenser for heating or cooling, thereby eliminating any wires from inside the house and further eliminating wire breakdown or rodent problems. The board can also be wired for heat pump applications.

It is an object of the present invention for the wireless circuit board to include the following features:

A. The board will have a minimum frequency range of 100 feet.

B. The board will not be more than 4" by 4" square so it can be easily installed in an existing or new condensing unit or a heat pump condensing unit.

C. The board will have an "on light" with a 3-5 amp fuse.

D. The board will come in two types:

(i) The control circuit will be 24 volts which will be wired into the unit 24-volt control circuit for straight cooling or heat pump applications on split systems for residential and commercial equipment.

(ii) The board can be used in residential and commercial applications where the unit is a split system and has a 24-volt control circuit for straight cooling or heat pump applications.

E. The control wireless circuit board can be used on all existing equipment when used with a new or existing 24 volt thermostat. The equipment the control board can be used for is:

(i) Heat pump condensing units; and (ii) Straight air conditioning condensing units.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
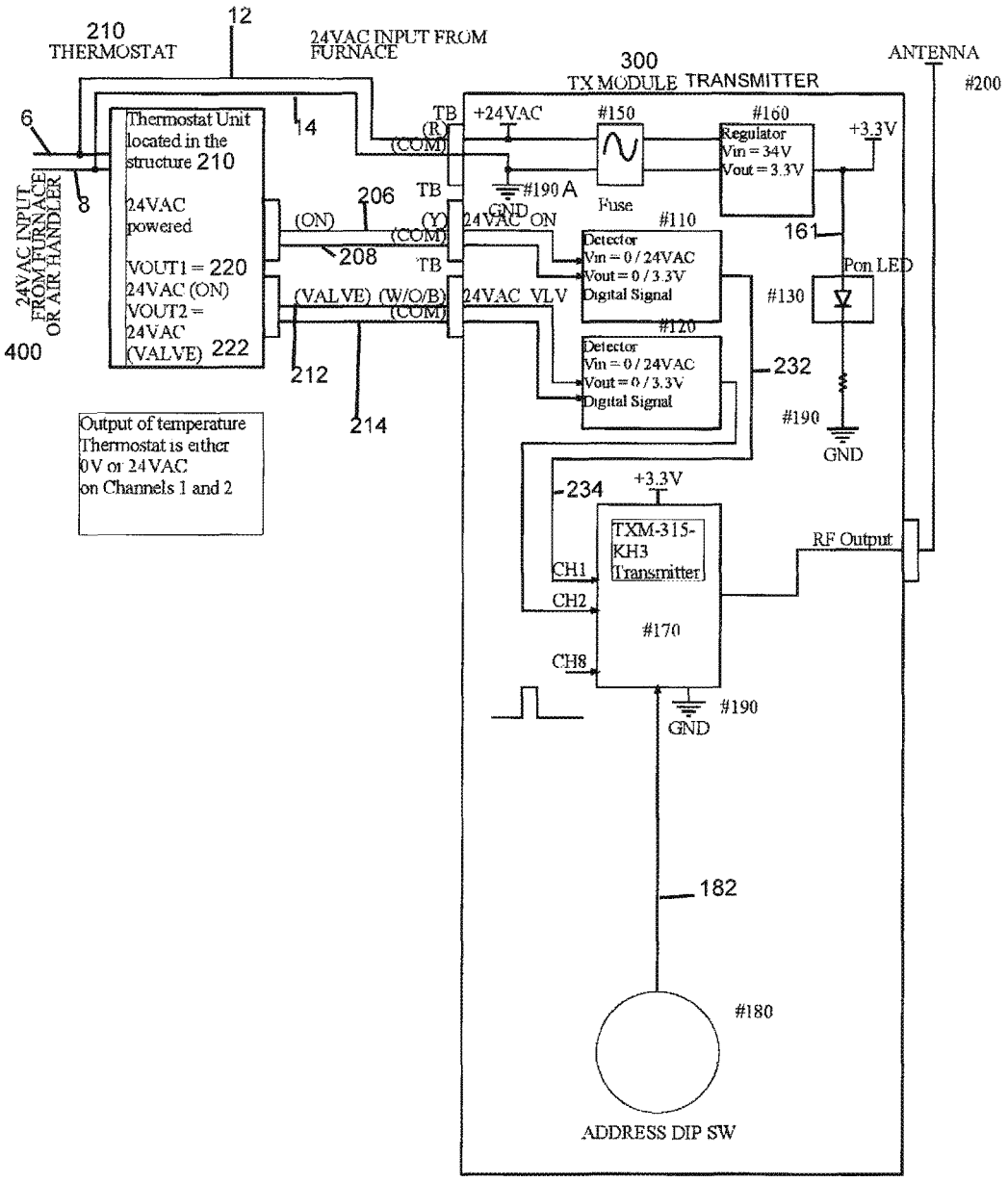
FIG. 1 is a block diagram illustrating an existing thermostat and an existing 24 VAC input from a furnace or air handler and the present invention TX module transmitter wireless circuit board used with an air conditioning condenser or air handler. This figure also illustrates a 24V thermostat connection, furnace connection or air handler connection with a TX module transmitter for the contactor and reversing valve at the condensing unit. This figure also illustrates the wireless circuit board in order to turn on the condensing unit and eliminates any wiring from the furnace or air handler to the condensing unit. The wireless TX module transmitter circuit board has a set of detectors, an"on light" and a fuse, a voltage regulator, receiver, an address dip switch, ground and antenna.

Referring to FIG. 1, there is illustrated a block diagram illustrating an existing thermostat and an existing 24 VAC input from a furnace or air handler and the present invention TX module transmitter wireless circuit board used with a furnace or air handler. There is also illustrated in FIG. 1 a 24V thermostat connection, furnace connection or air handler connection with a TX module transmitter for the contactor and reversing valve at the condensing unit. In FIG. 1 there is also illustrated the wireless circuit board in order to turn on the condensing unit and eliminate any wiring from the furnace or air handler to the condensing unit. Electricity of either 120V or 208V power from a source of electricity in a home, either a residential residence or commercial residence is hardwired to a transformer which is in the furnace or air handler. The transformer reduces the voltage to 24 VAC (voltage alternating current) and this is used to power the furnace and the air handler. The reduction in voltage from either 120V or 208V is converted through a transformer to 24 VAC. This is conventional. The 24 VAC from the furnace or air handler is 400 and this has two lines 6 and 8 which provide a 24 VAC source of power to the thermostat unit 210. Referring specifically to the function of cooling, the thermostat unit has two control sections which are powered on or off. The first selection is a VOUT1 switch 220 and a VOUT2 24AC reversing valve 322. From the thermostat 210, the on switch which is hardwired through wires 206 to 208 to the TX module transmitter 300. Also, the lines from the reversing valve 322 which is 212, 214 also goes to the TX module transmitter board 300.

Wired in parallel are the thermostat lines 12 and 14 which are respectively pulled off the voltage lines 6 and 8 which are lines from the 24 VAC source of power from the furnace or air handler. This is also wired in parallel and is also wired to the TX module transmitter board 300.

Described generally, the wireless transmitter TX module circuit board 300 has a set of detectors 110 and 120, an "on light" 130 and a fuse 150, a voltage regulator 160, a transmitter 170 and an address dip switch 180 with ground 190 and antenna 200.

Described in greater detail, the VOUT1 24 VAC on selection 220 is hardwired through lines 206 and 208 to the first detector 110 in the TX module transmitter board 300. The VOUT2 24 VAC reversing valve 322 is wired through lines 212 and 214 to the second detector 120. The electrical components of each detector are illustrated in FIG. 1. A regulator 160 converts the 24 VAC to 3.3 volts in first detector 110 and that is transmitted as a digital signal to the transmitter 170. Similarly, the rectifier 160 also converts the 24 VAC to 3.3 in the second detector 120 and that is transmitted as a digital signal to the transmitter 170. Therefore, first signal detector 110 transmits a digital signal through line 232 to the transmitter 170 and second signal detector 120 also transmits a digital signal through line 234 to transmitter 170. The model number of the transmitter TXM-315KH3 is illustrated in FIG. 1. The transmitter takes the input digital signals from lines 234 and 232 as described and an address dip switch 180 in the TX Module Transmitter board 300 board is hardwired to the transmitter 170 and is programmed with a specific address so that the TX signal transmitted from the transmitter 170 through antenna 200 will correlate with a receiver 280 in the RX Module Receiver board 290. After the address dip switch 180 is programmed, a corresponding given address is programmed into a dip switch 181 connected to the receiver so that the TX signal is transmitted from transmitter 170 through antenna 200 to receiving antenna 201A to receiver 180 with the same given address.

The thermostat lines 12 and 14, carrying 24 VAC input to the TX module transmitter board 300 and the two lines have one line connected to a ground 190A and the 24 volt lines 12 and 14 are connected to a fuse 150 which in turn from the hardwired line 12 and 14 are connected to a regulator 160. The regulator 160 is capable of regulating down from 34 volts down to 3.3 volts. For the present invention, the regulator 160 is used for regulating down from 24 volts to 3.3 volts. The regulator 160 then is connected by line 161 to the LED light 130 which in turn is connected to a second ground 190 and it is the lines 12 and 14 from the thermostat 210 that powers the TX module transmitter board 300. The lines are then connected to the light 130 which shows that there is power to the board and the line is connected to the ground 190 with 3.3 volts going to the light. It is this line from the thermostat that has just been discussed that powers the TX modular board. When described earlier, the detectors 110 and 120 are synonymous with the word "contact".

Figure 3:
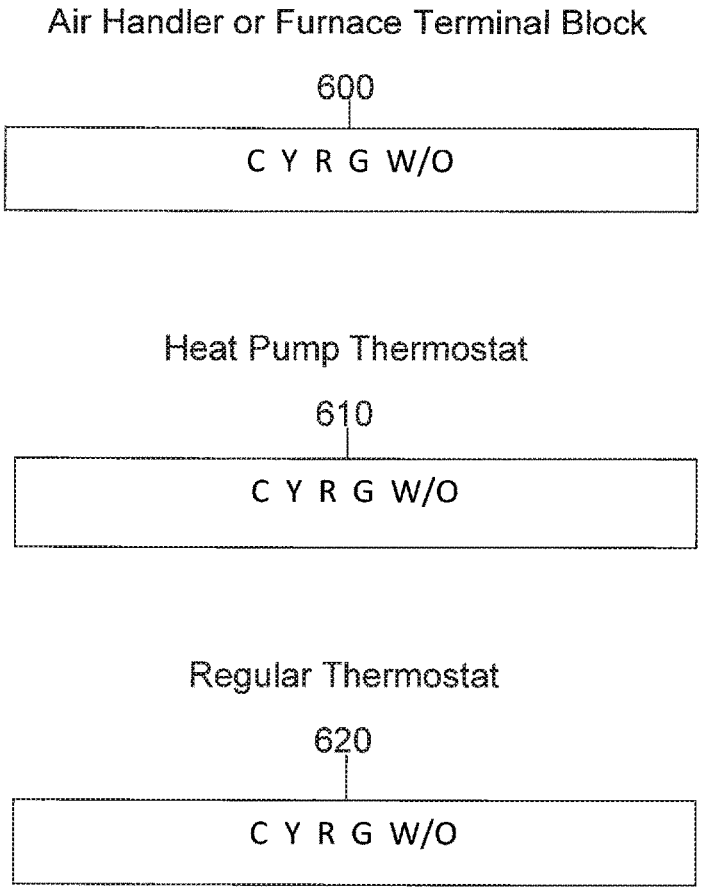
FIG. 3 is a block diagram illustrating an air handler or furnace terminal block adjacent to the furnace/air handler, a sub-base adjacent to a heat pump thermostat; and a sub-base adjacent to a regular thermostat.

Referring to FIG. 3, the power coming from the electricity in the house is converted down from 120 volts or 208 volts to 24 volts. After the power is converted down, the air handler or furnace terminal 600 is hardwired to the thermostat 210. Within the furnace or air handler is a terminal block 600 which has the following components: "C" is for common wiring, "Y" is for the cooling wiring, "R" is for the power wiring, "G" is for fan wiring and "W"/"O" is for heat wiring. The thermostat 210 can be either a heat pump thermostat or a regular thermostat. When a heat pump thermostat 210 is used, it has a sub-base 610 which has five connection points: "C" is for the common wiring, "Y" is for the cooling wiring, "R" is for the power wiring, "G" is for fan wiring and "W"/"O" is for heat wiring. When the thermostat 210 is a regular thermostat, it has a sub-base 620 having five connection points: "C" is for the common wiring, "Y" is for the cooling wiring, "R" is for the power wiring, "G" is for fan and "W"/"O" is for heat wiring. There are corresponding letters that go to the sub block in the furnace or air handler terminal block. The R hot goes to the R in the thermostat and then when there is a call for cooling, it coverts it to Y. The calling for cooling Y sends a signal for cooling in a condensing unit. In a heat pump application by calling for cooling, the signal is also to reversing valve 322 and brings on cooling. In a call for heat in a heat pump application, the signal only energizes the compressor. Normally the reversing valve 322 calls for cooling. However, if heat is desired, then the reversing valve 322 is de-energized in heat pump applications.

Figure 2:
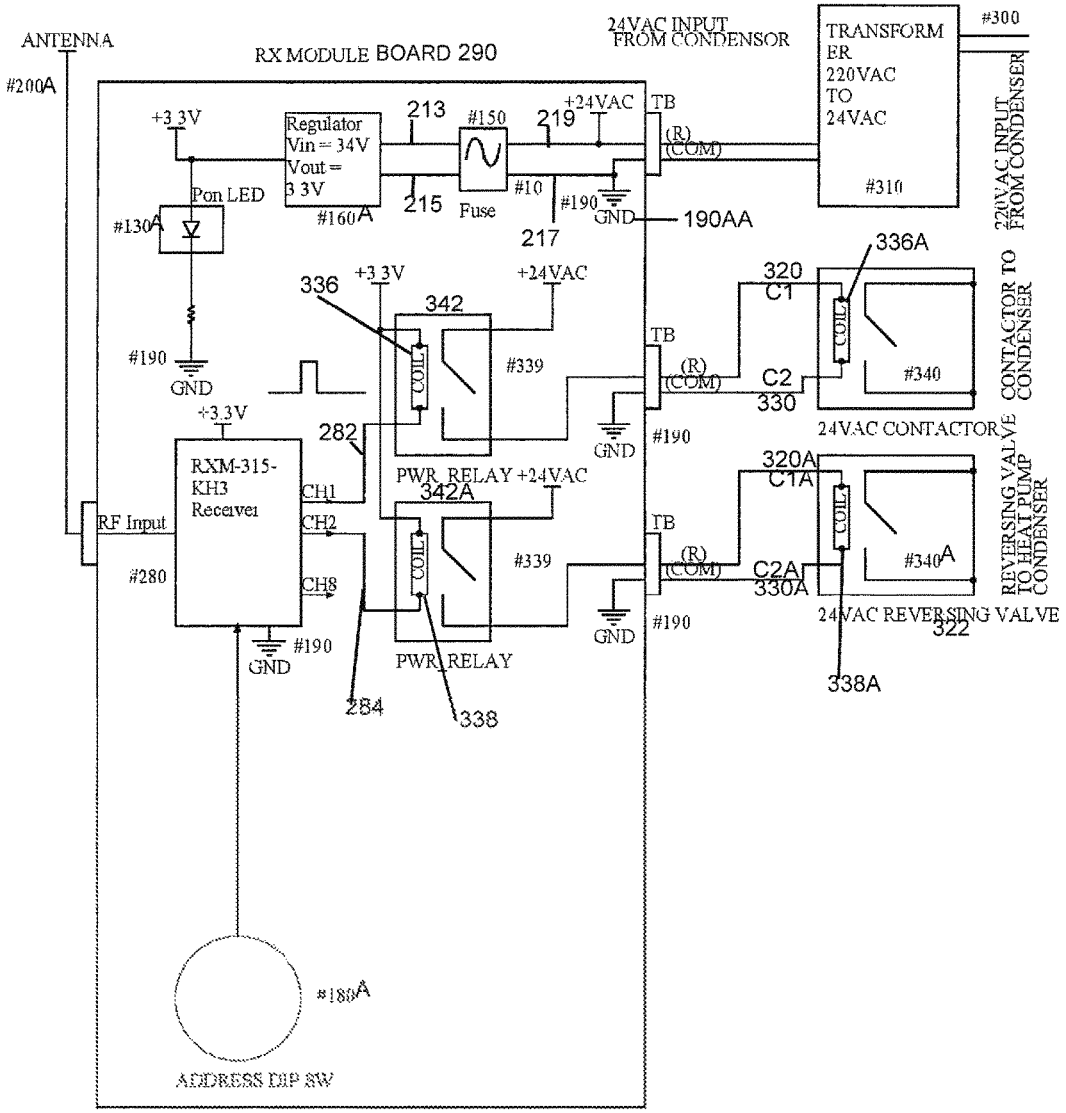
FIG. 2 is an electronic diagram of the present invention RX module receiver wireless circuit board and the present invention transformer connected to a 220V input from the air conditioning condenser or heat pump, and also illustrating between these two innovations an existing 24V VAC input from a condenser. The wireless RX module receiver circuit board has a set of detectors an "on light" and a fuse, a voltage regulator, a receiver, an address dip switch with ground and antenna.

Referring to FIG. 2, when the signal is transmitted from the TX module transmitter board 300, it is sent out to the antenna 200A at the RX module receiver board 290 which is located outside or in the condenser. The receiver 280 also has an address dip switch 180A which is programmed so it matches the address dip switch 180 so that the transmitter 170 and the receiver 280 talk to each other. The receiver 280 used in this particular example is an RMX-315-KH3 as an example. From the signal received from receiver 280 there is channel 1 CH1 which is hardwired through line 282 to the first power relay 342 which then contains within it a first coil 336 and a first normally open contact 339 and when the first coil 338 is energized at 3.3V, it closes the first normally open contact 339. Similarly, from the signal received from receiver 280 there is channel 2 CH2 which is hardwired through line 284 to the second power relay 342A which then contains within it a second coil 338 and a second normally open contact 339A and when the second coil 338 is energized at 3.3V, it closes the second normally open contact 339A.

An LED light 130A shows that the RX module receiver board 290 now has power. The LED light 130A is connected to the regulator 160A which on the board 290 is connected through contacts so that it reduces the voltage to the coils 338 and 338A from 24 volts to 3.3 volts and the regulator 160A is connected by lines 213 and 215 to a fuse 150 which then is connected by line 217 to a ground 190AA and by line 219 is connected to the 24 VAC input which it regulates down to 3.3 volts.

The signal from the first power relay 342 then goes through channel 1 C1 320 and channel 2 C2 330 to contact third coil 336A. There is a normally open switch 340 and this is part of the contactor to the condenser and when the coil 336 is energized, it closes the normally open switch 340 and brings on the cooling in the condensing unit. Similarly, the signal from the second power relay 342A then goes through channel 1A C1A 320A and channel 2A C2A 330A lines C1 and C320 to contact fourth coil 338A. There is a normally open switch 340A and this energizes the reversing valve 322 in the heat pump condenser. When the normally open switches 339, 339A, 340 and 340A are closed, then the compressor comes on and the heat pump condenser comes on in the air conditioning portion of the exterior unit to have the cooling. When the normally open switches 339 and 340 are closed and the normally open switches 339A and 340A remain open, then only the heating in the heat pump comes on. The condenser unit is hardwired to the air conditioning unit.

A key innovation of the present invention is that a transformer 310 is installed. The voltage in the air conditioning unit is 220. There is hardwiring from the electricity 220 that goes to the air conditioning unit and then that is converted by the transformer. The transformer is hardwired to the board 290 and then the board 290 goes through the above-described process.

To further clarify the present invention, the RX module receiver board illustrates a different wireless circuit board 290 with two sets of normally open contacts 329 and 329A. There are two sets because in the heat pump controls both heating and cooling through the condensing unit heat pump. When both coils 339 and 339A are energized and therefore both switches 340 and 340A are closed, cooling occurs because the condenser is energized. If only heating is desired, the second coil 339A and switch 340A remain open.

There are two sets of normally open contacts because the heat pump controls both heating and cooling through the condensing unit heat pump. Heating and cooling exist together in the heat pump. The coils 336A and 338A are in the heat pump condensing unit. The reversing valve 322 is in the heat pump condensing unit.

Described in detail when used with an air conditioning condenser or a cooling condenser unit, the present invention is an apparatus to wirelessly turn on and turn off an air conditioning condenser at a location external to a structure where a thermostat is located, a source of electricity hardwired to a transformer in a furnace, the transformer reducing the voltage from the source of electricity to 24 volts alternating current, comprising: (a) The thermostat including two control sections which are powered on or off. a first section having a VOUT1 24 volt alternating current switch and a VOUT2 24AC reversing valve, from the thermostat an on switch electrically wired to a module transmitter board, the reversing valve electrically connected to the module transmitter board, the thermostat electrically connected to the 24 volts alternating current and electrically connected to module transmitter board; (b) the module transmitter board including a first detector, a second detector, an on light, a fuse, a voltage regulator, a transmitter, an address dip switch, a ground and antenna; (c) the Vout1 24 volt alternating current switch electrically connected to the first detector, the reversing valve electrically connected to the second detector, a regulator reducing 24 volts alternating current to 3.3 volts alternating current and electrically connected to the first detector, the second detector and to a transmitter, the first detector electrically connected to and transmitting a digital signal to the transmitter and the second detector electrically connected to and transmitting a digital signal to the transmitter, (d) a programmable first address dip switch programmed with a specific address electrically connected to the transmitter, the transmitter transmitting an electrical signal obtained from the digital signal of the first detector, the digital signal of the second detector and the specific address through a transmitting antenna; (e) a module receiving board located at the air condenser and including a receiving antenna to wirelessly receive a signal from the transmitter, a programmable second address dip switch programmed with the specific address matching the first address dip switch, and electrically connected to a receiver which wireless receives and connects with the signal from the transmitter, (f) a transformer electrically connected to electricity from the condenser and reduces the voltage to 24 variable alternating current which is then electrically connected to the module receiver board; (g) the module transmitter board including an on light, a fuse, and a voltage regulator which reduces 24 volts alternating current to 3.3 volts variable alternative current and is electrically connected to the on light, the first coil and the second coil; (h) the receiver electrically connected to a first power relay having a first coil and a first normally open contact, the first power relay electrically connected to a 24 volt alternating current switch having a third coil and a third normally open contact, the receiver electrically connected to a second power relay having a second coil and a second normally open contact, the second power relay electrically connected to a 24 volt alternating current reversing valve having a fourth coil and a fourth normally open contact; (i) the module transmitter board including an on light, a fuse, and a voltage regulator which reduces 24 volts alternating current to 3.3 volts variable alternative current and is electrically connected to the on light, the first coil and the second coil; (j) in a first condition a signal received from receiver energizes the first coil at 3.3 volts variable alternating current which in turn closes the first normally open contact which energizes the third coil which in turn closes the third normally open contact, the signal received from receiver also energizes the second coil at 3.3 volts variable alternating current which in turn closes the second normally open contact which energizes the fourth coil which in turn closes the fourth normally open contact, to turn on air conditioning from the heat pump condenser for cooling in a heat pump application; (k) in a second condition a signal received from receiver energizes the first coil at 3.3 volts variable alternating current which in turn closes the first normally open contact which energizes the third coil which in turn closes the third normally open contact, the signal received from receiver does not energize the second coil in turn closes the retains the second normally open contact in an open condition which does not energize the fourth coil which in turn retains the fourth normally open contact in the open condition to turn on heat from the furnace; and (l) in a third condition a signal received from the receiver energizes the first coil at 3.3 volts variable alternating current which in turn closes the first normally open contact which energizes the third coil which in turn closes the third normally open contact and brings on the cooling in a structure in a regular split system application.

Described more broadly, the present invention is an apparatus to control the condenser of a cooling condensing unit member comprising: (a) a 24 volt heat pump thermostat in a structure; (b) a transmitter circuit board electrically connected to the 24 volt thermostat, the transmitter circuit board having a transmitter to transmit a given signal; (c) a wireless receiver circuit board internally wired to the cooling condensing unit to provide a wireless connection between the wireless receiver circuit board and the transmitter circuit board, the wireless receiver circuit board having a receiver which receives the given signal from the transmitter; (d) the wireless receiver circuit board including a first pair of normally open contacts respectively in a power relay and a 24 VAC contact, and a second pair of normally open contacts respectively in a power relay and a reversing valve; and (e) when a cooling signal from the 24 volt thermostat occurs, the wireless receiver circuit board in the cooling condensing unit is energized, the first pair of normally open contacts are closed and the second pair of normally open contacts are also closed and the cooling condenser of the cooling condenser unit is wirelessly turned on to thereby eliminate a need to hard wire the cooling condensing unit.

When used in conjunction with a heat pump condenser, then defined alternatively in detail the present invention is an apparatus to wirelessly turn on and turn off a heat pump condenser at a location external to a structure where a thermostat is located, a source of electricity hardwired to a transformer in an air handler, the transformer reducing the voltage from the source of electricity to 24 volts alternating current, comprising: (a) the thermostat including two control sections which are powered on or of(f) a first section having a VOUT1 24 volt alternating current switch and a VOUT2 24AC reversing valve, from the thermostat an on switch electrically wired to a module transmitter board, the reversing valve electrically connected to the module transmitter board, the thermostat electrically connected to the 24 volts alternating current and electrically connected to module transmitter board; (b) the module transmitter board including a first detector, a second detector, an on light, a fuse, a voltage regulator, a transmitter, an address dip switch, a ground and antenna; (c) the Vout1 24 volt alternating current switch electrically connected to the first detector, the reversing valve electrically connected to the second detector, a regulator reducing 24 volts alternating current to 3.3 volts alternating current and electrically connected to the first detector, the second detector and to a transmitter, the first detector electrically connected to and transmitting a digital signal to the transmitter and the second detector electrically connected to and transmitting a digital signal to the transmitter, (d) a programmable first address dip switch programmed with a specific address electrically connected to the transmitter, the transmitter transmitting an electrical signal obtained from the digital signal of the first detector, the digital signal of the second detector and the specific address through a transmitting antenna; (e) a module receiving board located at the heat pump condenser and including a receiving antenna to wirelessly receive a signal from the transmitter, a programmable second address dip switch programmed with the specific address matching the first address dip switch, and electrically connected to a receiver which wireless receives and connects with the signal from the transmitter; (f) a transformer electrically connected to electricity from the heat pump condenser and reduces the voltage to 24 variable alternating current which is then electrically connected to the module receiver board; (g) the module transmitter board including an on light, a fuse, and a voltage regulator which reduces 24 volts alternating current to 3.3 volts variable alternative current and is electrically connected to the on light, the first coil and the second coil; (h) the receiver electrically connected to a first power relay having a first coil and a first normally open contact, the first power relay electrically connected to a 24 volt alternating current switch having a third coil and a third normally open contact, the receiver electrically connected to a second power relay having a second coil and a second normally open contact, the second power relay electrically connected to a 24 volt alternating current reversing valve having a fourth coil and a fourth normally open contact; (i) the module transmitter board including an on light, a fuse, and a voltage regulator which reduces 24 volts alternating current to 3.3 volts variable alternative current and is electrically connected to the on light, the first coil and the second coil; (j) in a first condition a signal received from the receiver energizes the first coil at 3.3 volts variable alternating current which in turn closes the first normally open contact which energizes the third coil which in turn closes the third normally open contact, the signal received from receiver also energizes the second coil at 3.3 volts variable alternating current which in turn closes the second normally open contact which energizes the fourth coil which in turn closes the fourth normally open contact, to turn on air conditioning from the heat pump condenser, and (k) in a second condition a signal received from the receiver energizes the first coil at 3.3 volts variable alternating current which in turn closes the first normally open contact which energizes the third coil which in turn closes the third normally open contact, the signal received from receiver does not energize the second coil which retains the second normally open contact in an open condition and which does not energize the fourth coil which in turn retains the fourth normally open contact in the open condition to turn on heat from the heat pump condenser.

Defined more broadly when used with a heat pump condenser, the present invention is defined more broadly as an apparatus to control the condenser of heat pump condensing unit member comprising: (a) a 24 volt thermostat in a structure; (b) a transmitter circuit board electrically connected to the 24 volt thermostat, the transmitter circuit board having a transmitter to transmit a given signal; (c) a wireless receiver circuit board internally wired to the heat pump condenser to provide a wireless connection between the wireless receiver circuit board and the transmitter circuit board, the wireless receiver circuit board having a receiver which receives the given signal from the transmitter, (d) the wireless receiver circuit board including a first pair of normally open contacts respectively in a power relay and a 24 VAC contact, and a second pair of normally open contacts respectively in a power relay and a reversing valve; (e) in a first condition a cooling signal from the 24 volt thermostat occurs, the wireless receiver circuit board in the condenser is energized, the first pair of normally open contacts are closed and the second pair of normally open contacts are closed and the heat pump condensing unit is wirelessly turned (f) thereby eliminate a need to hard wire an air handler; and (f) in a second condition a heating signal from the 24 volt thermostat occurs, the wireless receiver circuit board in the condenser is energized, the first pair of normally open contacts are closed and the second pair of normally open contacts remain open and the heat pump condensing unit is wirelessly turned on to thereby eliminate a need to hard wire the air handler.

An example of installation of the present unit is as follows. Install from kit the 208/220 v-24 v Transformer 310 into outdoor Air Conditioning Condensing unit or Heat Pump Condensing unit, Wire 24 v power from Transformer 310 to Rx modular receiver board 290 input connections, terminal block connections "R" and "Common".

The coils are in the condensing unit.

At the Outdoor Condensing unit 340, wire 24V yellow wire from contactor coil 342 to "R" terminal block 318 on RX Module 290. Take the Brown wire or Common wire 330 from the contactor coil 342 and install onto the common terminal block 322 "common". Use wire provided.

Only wire these connections if "Heat Pump Operation" exists. From the Heat Pump Condenser take the reversing valve wire 24 v and connect it to the "R" terminal at the RX Module. Take the common wire of the reversing valve and connect it to the "Common" terminal of the RX Module.

All other wiring will be per manufacturer's diagram.

Sequence of Operations:

TX Module is powered by the furnace or heat pump air handler. At the TX Module power goes through the fuse, regulator and LED power "on light". When 24 v control thermostat calls for cooling demand, thermostat sends a signal to the TX Module. Once the TX Module sees the signal and is addressed through the addressed dip switches corresponding to the RX Module address dip switch a signal will be sent closing the contactor and cooling will come.

When 24 v control heat pump thermostat calls for heating in a "Heat Pump" operation, thermostat sends signal to TX Module, thus sending wireless signal to RX Module, closing power relay contacts for outdoor heat pump condensing unit and will energize compressor for heat.

When 24 v control heat pump thermostat calls for cooling in a "Heat Pump" operation, thermostat sends signal to TX Module, thus sending wireless signal to both detectors which will send a signal to the RX Module which will close both power relays and energize reversing valve and contactor.

The coils are located in the condensing unit. The wireless receiver is in the condensing unit.

This is a condenser unit that causes the cooling and the heating.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A thermostat located in a structure, an apparatus to wirelessly turn on and off a compressor of an alternating current air condensing unit of an air conditioner at a location external to said structure, the apparatus comprising:

a. a furnace in said structure;

b. said thermostat having a control section including a first section having a VOUT1 24 volt alternating current electrically wired to and connecting the thermostat to a module transmitter board located at the furnace;

c. said module transmitter board including a first detector, an on light, a fuse, a voltage regulator, a transmitter, a programmable address dip switch, a ground and a transmitting antenna;

d. in the module transmitter board, the VOUT1 24 volt alternating current electrically connected to the first detector, the voltage regulator reducing 24 volts alternating current to 3.3 volts direct current in the first detector and the first detector electrically connected with 3.3 volts direct current to the transmitter and transmitting a digital signal to the transmitter;

e. said programmable first address dip switch programmed with a specific address electrically connected to the transmitter, the transmitter transmitting an electrical signal obtained from the digital signal of the first detector and the specific address through the transmitting antenna;

f. the alternating current air condenser unit electrically connected to a 220 volt alternating current transformer to reduce the 220 volt alternating current to 24 volts alternating current, the transformer electrically connected to a module receiver board;

g. the module receiver board including a regulator reducing the 24 volts alternating current received from the transformer to 3.3 volts direct current electrically connected to an LED light, a ground, a fuse, and a receiver in the modular receiving board;

h. the module receiver board located at the alternating current air condensing unit, the module receiver board including a receiving antenna to wirelessly receive said digital signal and specific address transmitted from said transmitting antenna, the module receiver board including a programmable second address dip switch programmed with the specific address matching the first address dip switch and electrically connected to a receiver which in turn is electrically connected to the receiving antenna;

i. the receiver electrically connected to a first power relay having a first coil and a first normally open contact within the module receiver board, the first power relay electrically connected to a third coil and a third normally open contact within the module receiver board and electrically connected to the alternating current air conditioner condensing unit and the compressor; and j. when cooling is set in the thermostat, a signal for cooling is received in the first detector of the module transmitter board and transmitted through the transmitter to the transmitting antenna which wirelessly sends the signal to the receiving antenna which in turn electrically sends the signal the receiver in the module receiver board which sends the signal through the first power relay which energizes the first coil which closes the first normally open contact which energizes the third coil which in turn closes the third normally open contact to turn on the compressor of the alternating current air condensing unit.

2. A thermostat located in a structure, an apparatus to wirelessly turn on and off a condenser of a heat pump and a reversing valve at a location external to said structure, the apparatus comprising:

a. an air handler in said structure;

b. said thermostat having a control section including a first section having a VOUT1 24 volt alternating current electrically wired to and connecting the thermostat to a module transmitter board located at the air handler;

c. said module transmitter board including a first detector, an on light, a fuse, a voltage regulator, a transmitter, a programmable first address dip switch, a ground, and a transmitting antenna;

d. the transmitting antenna electrically connected to the transmitter and a second detector to allow the transmitting antenna to send a wireless signal to a reversing valve located externally from the air handler;

e. in the module transmitter board, the VOUT1 24 volt alternating current is electrically connected to the first detector, the voltage regulator reducing 24 volts alternating current to 3.3 volts direct current in the first detector and the first detector electrically connected with 3.3 volts direct current to the transmitter and transmitting a first digital signal to the transmitter;

f. the control section including a second section having in the module transmitter board a VOUT2 24 volts alternating current electrically wired to a reversing valve circuit in turn electrically connected to the second detector;

g. in the module transmitter board, the VOUT2 24 volt alternating current is electrically connected to the second detector, the voltage regulator reducing 24 volts alternating current to 3.3 volts direct current in the second detector and the second detector electrically connected with 3.3 volts direct current to the transmitter and transmitting a second digital signal to the transmitter;

h. said programmable first address dip switch programmed with a first specific address electrically connected to the transmitter, the transmitter transmitting a first electrical signal obtained from the first digital signal of the first detector through the transmitting antenna and said programmable first address dip switch programmed with a second electrical signal obtained from the second detector and the specific address through the transmitting antenna and transmitting a second electrical signal obtained from the second digital signal of the second detector through the transmitting antenna;

i. the heat pump condenser electrically connected to a 220 volt alternating current transformer to reduce the 220 volt alternating current to 24 volts alternating current, the transformer electrically connected to a module receiver board;

j. the module receiver board including a regulator reducing the 24 volts alternating current received from the transformer to 3.3 volts direct current electrically connected to an LED light, a ground, a fuse, and a receiver in the module receiver board;

k. the module receiver board located at the heat pump, the module receiver board including a receiving antenna to wirelessly receive said first digital signal and specific first address transmitted from said transmitting antenna, and to wirelessly receive said second digital signal and specific second address transmitted from said transmitting antenna, and the module receiver board including a programmable second address dip switch programmed with the specific second address and the second address matching the first address dip switch and electrically connected to a receiver which in turn is electrically connected to the receiving antenna;

l. the receiver electrically connected to a first power relay having a first coil and a first normally open contact within the module receiver board, the first power relay electrically connected to a third coil and a third normally open contact within the module receiver board and electrically connected to the heat pump condenser;

m. the receiver electrically connected to a second power relay having a second coil and a second normally open contact within the module receiver board, the second power relay electrically connected to a fourth coil and a fourth normally open contact within the module receiver board and electrically connected to the reversing valve;

n. when cooling is set in the thermostat, a signal for cooling which includes both the first electrical signal and the second electrical signal, the signal for cooling is received in the first and second detectors of the module transmitter board and transmitted through the transmitter to the transmitting antenna which wirelessly sends the first and second electrical signals to the receiving antenna which in turn electrically sends the first electrical signal to the receiver in the module receiver board which sends the signal through the first power relay which energizes the first coil which closes the first normally open contact which energizes the third coil which in turn closes the third normally open contact to turn on the heat pump condenser and which in turn electrically sends the second electrical signal to the receiver in the module receiver board which sends the signal through the second power relay which energizes the second coil which closes the second normally open contact which energizes the fourth coil which in turn closes the fourth normally open contact to turn on the reversing valve to provide cooling to the structure; and o. when heating is set in the thermostat, a signal for heating which includes only the first electrical signal, the signal for heating is received in the first detector of the module transmitter board and transmitted through the transmitter to the transmitting antenna which wirelessly sends the first electrical signal to the receiving antenna which in turn electrically sends the first electrical signal to the receiver in the module receiver board which sends the signal through the first power relay which energizes the second coil which closes the first normally open contact which energizes the third coil which in turn closes the third normally open which turns on the heat pump condenser to provide heating to the structure.

3. An air conditioning system including, an apparatus to wirelessly turn on and off a compressor of a condensing unit, the apparatus comprising:

a. an air handler located adjacent a structure having a thermostat and separated from said condensing unit with a wireless connection connecting said air handler and said condensing unit;

b. said condensing unit having a compressor, a cooling condenser, a module transmitter board, and a module receiver board;

c. said module transmitter board including a first detector, a second detector, a fuse, a voltage regulator, a transmitter, a ground, and a receiving antenna;

d. said module receiver board located at said compressor and condensing unit with said module receiver board including a receiver, a receiving antenna to wirelessly receive a signal from said transmitter, a first programmable address dip switch and a second programmable address dip switch with said second programmable address dip switch programmed with a specific address matching said first programmable address dip switch;

e. a control transformer electrically connected to the module receiver board to power the receiving module receiver board;

f. a thermostat located adjacent said air handler with said thermostat including a control section with said control section having a first VOUT1 24 volt alternating current switch;

g. the first Vout1 24 volt alternating current switch connected to the first detector and a reversing valve connected to the second detector, with the first detector connected to and transmitting a digital signal to the transmitter and the second detector connected to and transmitting a digital signal to said transmitter;

h. the receiver electrically connected to a first power relay having a first coil and a first normally open contact, the first power relay connected to said VOUT1 24 volt alternating current switch having a third coil and a third normally open contact, the receiver connected to a second power relay having a second coil and a second normally open contact, the second power relay connected to a second VOUT2 24 volt alternating current reversing valve having a fourth coil and a fourth normally open contact; and i. a signal received from the receiver energizes the first coil at 3.3 volts alternating current which in turn closes the first normally open contact which energizes the third coil which in turn closes the third normally open contact, the signal received from receiver also energizes the second coil at 3.3 volts alternating current which in turn closes the second normally open contact which energizes the fourth coil which in turn closes the fourth normally open contact, to turn on said air conditioning system.

4. The air conditioning system in accordance with claim 3, further comprising: said voltage regulator reduces the alternating current from 24 volts alternating current to 3.3 volts alternating current.

5. The air conditioning system in accordance with claim 3, further comprising:

the antenna electrically connected to the transmitter and a second detector to allow the antenna to send a wireless signal to the reversing valve located externally from the air handler.

6. The air conditioning system in accordance with claim 3, further comprising: the module transmitter board includes an on light.

* * * * *